US007274893B2

(12) United States Patent
Morimoto et al.

(10) Patent No.: US 7,274,893 B2
(45) Date of Patent: Sep. 25, 2007

(54) IMAGE FORMING APPARATUS SUPPORT STRUCTURE

(75) Inventors: Shigenori Morimoto, Nara (JP); Takahiro Fukunaga, Nara (JP); Ryohsuke Sugiyama, Nara (JP); Tatsuya Ogawa, Kyoto (JP); Haruo Sayama, Nara (JP)

(73) Assignee: Sharp Kabushiki Kaisha, Osaka-shi (JP)

( * ) Notice: Subject to any disclaimer, the term of this patent is extended or adjusted under 35 U.S.C. 154(b) by 0 days.

(21) Appl. No.: 11/036,044

(22) Filed: Jan. 18, 2005

(65) Prior Publication Data

US 2005/0196192 A1 Sep. 8, 2005

(30) Foreign Application Priority Data

Jan. 20, 2004 (JP) ..... 2004-012005

(51) Int. Cl.
*G03G 15/00* (2006.01)
*A47B 37/00* (2006.01)

(52) U.S. Cl. ..... 399/107; 108/50.01

(58) Field of Classification Search ..... 399/107; 248/903; 52/730.1, 730.4, 730.5, 731.2, 52/731.7; 174/48, 49; 108/50.01, 50.02, 108/153.1, 158.11

See application file for complete search history.

(56) References Cited

U.S. PATENT DOCUMENTS 686,817 A * 11/1901 Macphail ..... 52/731.2 X
2,975,874 A * 3/1961 Pagan ..... 52/731.2 X
6,167,221 A * 12/2000 Kobayashi ..... 399/107
6,636,338 B1 * 10/2003 Kida et al. ..... 399/107 X

FOREIGN PATENT DOCUMENTS

| | | | |
|---|---|---|---|
| JP | 62050771 A | * | 3/1987 |
| JP | 06175419 A | * | 6/1994 |
| JP | 07271131 A | * | 10/1995 |
| JP | 2000-082881 A | | 3/2000 |
| JP | 2000-138470 A | | 5/2000 |
| JP | 2003-270886 A | | 9/2003 |

* cited by examiner

*Primary Examiner*—David M. Gray
*Assistant Examiner*—Erika J. Villaluna
(74) *Attorney, Agent, or Firm*—Birch, Stewart, Kolasch & Birch, LLP

(57) ABSTRACT

Provided is an image forming apparatus support structure which permits improvements in both strength and dimensional accuracy, and which can also accommodate increases in size. Because respective coupling member(s) and steel channel of respective post member(s) may be sequentially and individually connected, it is possible to improve support structure dimensional accuracy, it being possible to assemble support structure(s) such that deviation(s) in the respective coupling member(s) and the respective post member(s) offset(s) one another. Furthermore, steel channel is suitable for supporting load(s) in vertical direction(s). Moreover, respective coupling member(s) may serve as brace(s) when interposed between respective post members. Where this is the case, strength of the overall support structure may be made extremely high, and strain exhibited by the overall support structure may be reduced.

3 Claims, 4 Drawing Sheets

IMAGE FORMING APPARATUS SUPPORT STRUCTURE

BACKGROUND OF INVENTION

This application claims priority under 35 USC 119(a) to patent application Ser. No. 2004-12005 filed in Japan on 20 Jan. 2004, the content of which is hereby incorporated herein by reference in its entirety.

The present invention relates to an image forming apparatus support structure for supporting various constituent elements making up an image forming apparatus.

Such support structures include structures in which framework element(s) is/are attached to base section(s) of an image forming apparatus, and other respective frame element(s) is/are sequentially attached over such framework element(s). This permits improvement in support structure strength and dimensional accuracy.

However, support structures of this type have suffered from defects such as the extremely large weight thereof and the fact that handling of the image forming apparatus has been made difficult thereby.

Various support structures excelling in strength and dimensional accuracy, as well as being suited to lightweight applications, have been proposed. For example, at Japanese Patent Application Publication Kokai No. 2000-138470 (hereinafter "Patent Reference No. 1"), art is disclosed in which a support structure manufactured by welding steel part(s) having rectangular cross-section is formed, various constituent elements being supported by the support structure.

Employment of support structures making use of rectangular steel part(s) of this type as key component is very advantageous, as it facilitates reduction in weight, makes it possible to ensure support structure strength and dimensional accuracy, and makes it possible to achieve simplification in attachment procedures for various constituent elements.

Furthermore, at Japanese Patent Application Publication Kokai No. 2000-82881 (hereinafter "Patent Reference No. 2"), art is disclosed in which steel part(s) having C-shaped cross-section is/are used instead of rectangular steel part(s) to construct a support structure, the space at the interior of the steel channel being efficiently utilized and further reduction in weight being achieved.

However, recent trends toward increased use of digital technology in copier markets and trends favoring increases in apparatus size and speed in printer markets have brought is with them demand for improved positional accuracy among various constituent elements and new levels of reduction and so forth with respect to vibration, strain, and the like of the overall apparatus. In other words, greater strength and dimensional accuracy is demanded of the image forming apparatus support structure.

However, the support structures of Patent References Nos. 1 and 2, because they are assembled by mutually coupling steel channel and/or rectangular steel part(s), have not permitted more than a certain amount of strength to be obtained; and where greater strength has been required, they have, due to their inadequate strength, not permitted dimensional accuracy to be maintained.

It is therefore an object of the present invention, which was conceived in light of the foregoing conventional problems, to provide an image forming apparatus support structure which permits improvements in both strength and dimensional accuracy, and which can also accommodate increases in size.

SUMMARY OF INVENTION

In order to solve the foregoing and/or other problems, in accordance with one or more embodiments of the present invention, an image forming apparatus support structure for supporting various constituent elements making up an image forming apparatus comprises a plurality of post members; and a plurality of coupling members mutually coupling at least a portion of the post members; wherein at least a portion of the post members comprises steel channel having more or less C-shaped cross-section; at least a portion of the coupling members comprises at least one member having more or less L-shaped cross-section and/or more or less C-shaped cross-section; and at least a portion of the post members and at least a portion of the coupling members are individually connected to form the image forming apparatus support structure.

In accordance with one or more embodiments of the present invention, the support structure may be formed by individually connecting at least a portion of the respective post members comprising steel channel and at least a portion of the respective coupling members comprising at least one member having more or less L-shaped cross-section and/or more or less C-shaped cross-section. Steel channel may be employed for at least a portion of the respective post members because it is suitable for supporting loads in vertical directions; moreover, it is suitable for ensuring creation of space at the interior of at least a portion of the respective post members. Furthermore, member(s) having more or less L-shaped cross-section and/or more or less C-shaped cross-section is/are suitable for coupling at least a portion of the respective post members, increasing strength of the overall support structure, and reducing strain of the overall support structure. By thus employing steel channel for at least a portion of the respective post members and employing at least one member having more or less L-shaped cross-section and/or more or less C-shaped cross-section for at least a portion of the respective coupling members, it is possible to improve strength of the support structure without causing concomitant increase in weight of the support structure. Furthermore, because at least a portion of the respective post members comprising steel channel and at least a portion of the respective coupling members comprising at least one member having more or less L-shaped cross-section and/or more or less C-shaped cross-section are individually connected, it is possible to improve dimensional accuracy of the support structure, it being possible to assemble the support structure such that error(s) in dimension(s) of at least a portion of the respective post members and at least a portion of the respective coupling members offset one another.

Furthermore, in accordance with one or more embodiments of the present invention, at least one of the post members may be steel part(s) having rectangular cross-section and formed by fixedly combining two pieces of steel channel.

Where this is the case, because steel part(s) having rectangular cross-section and formed by fixedly combining two pieces of steel channel is employed for at least one of the post members, it will be possible to further improve strength of the support structure.

Moreover, in accordance with one or more embodiments of the present invention, at least one of the coupling members may be used as at least one outer wall panel for the constituent elements of the image forming apparatus.

Where this is the case, because at least one of the coupling members is used as at least one outer wall panel for the constituent elements of the image forming apparatus, it is possible to achieve reduction in weight and parts count of the image forming apparatus.

Furthermore, in accordance with one or more embodiments of the present invention, at least a portion of the post members and at least a portion of the coupling members may be connected by spot welding and/or by fastening with at least one screw.

Where this is the case, because at least a portion of the post members and at least a portion of the coupling members are connected by spot welding and/or by fastening with at least one screw, it is possible to improve dimensional accuracy of the support structure, it being possible to assemble the support structure such that error(s) in dimension(s) of at least a portion of the respective post members and at least a portion of the respective coupling members offset one another.

DESCRIPTION OF PREFERRED EMBODIMENTS

Below, embodiments of the present invention are described in detail while referring to the attached drawings.

First Embodiment

Figure 1:
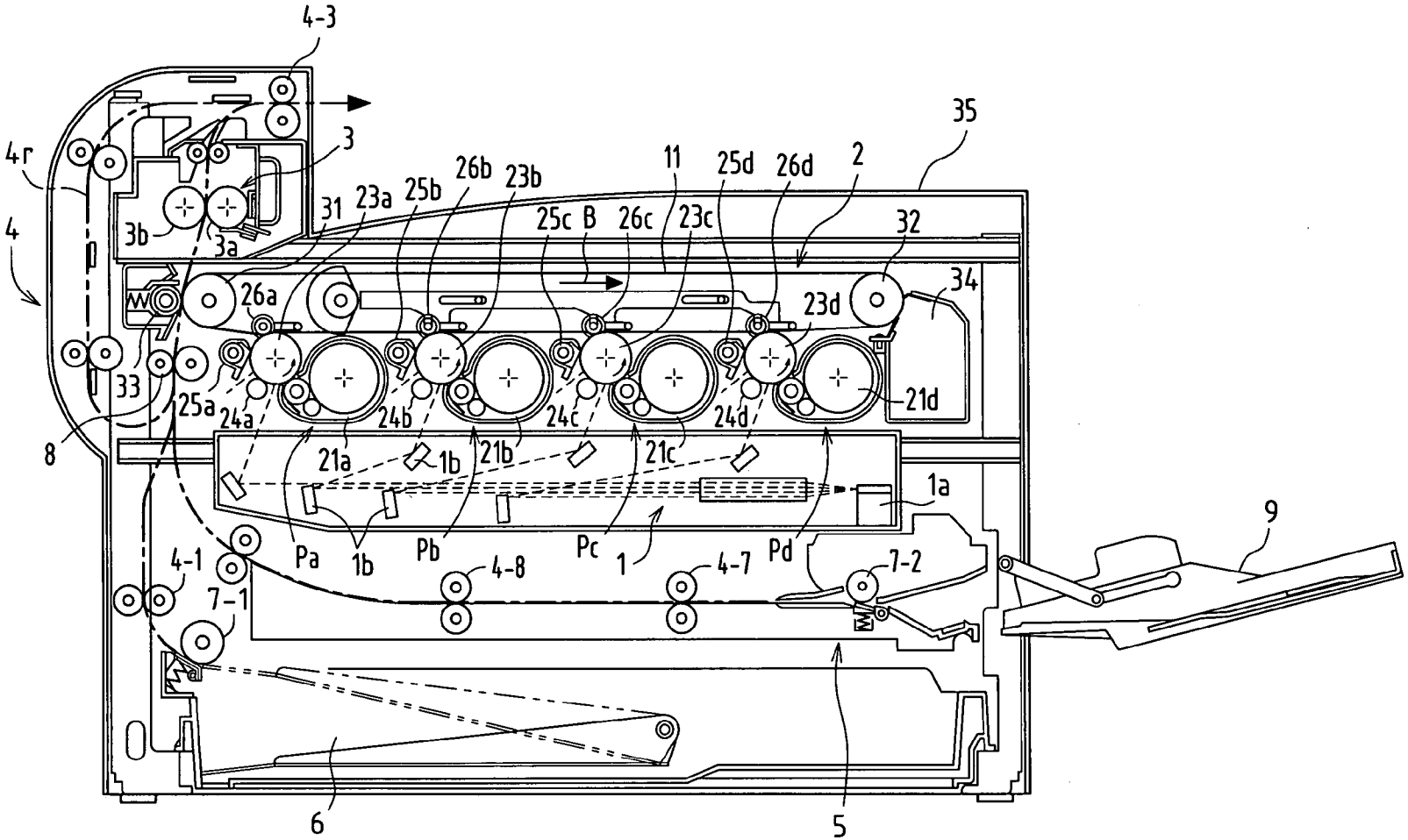
FIG. 1 is a side view showing a first embodiment of an image forming apparatus in accordance with the present invention.

FIG. 1 is a side view showing a first embodiment of an image forming apparatus in accordance with the present invention. The image forming apparatus of the present embodiment, being a color laser printer that records color images onto recording paper, is equipped with exposing unit(s) 1; respective image forming station(s) Pa, Pb, Pc, Pd; intermediate transfer belt unit(s) 2; fuser unit(s) 3; paper transport apparatus(es) 4; media supply apparatus(es) 5; and so forth.

At this image forming apparatus, recording paper is respectively stored in stacked fashion in a plurality of automatic-feed cassettes 6. At paper transport apparatus 4, recording paper is taken up one sheet at a time by takeup roller(s) 7-1 from any of the automatic-feed cassettes 6, and the recording paper is transported by pair(s) of transport rollers 4-1 to pair(s) of registration rollers 8.

Alternatively, recording paper may be placed in or on manual-feed tray(s) 9. At media supply apparatus 5, recording paper is taken up by takeup roller(s) 7-2 from manual-feed tray 9, and the recording paper is transported by respective pairs of transport rollers 4-7, 4-8 to pair(s) of registration rollers 8 of paper transport apparatus 4.

At paper transport apparatus 4, the recording paper is temporarily made to stop at registration roller pair 8 and the lead edge of the recording paper is aligned, the recording paper being transported by registration roller pair 8 to secondary transfer roller(s) 33 with such timing as to cause the lead edge of the recording paper to coincide with lead edge(s) of toner image(s) formed on intermediate transfer belt(s) 11 of intermediate transfer belt unit 2.

Respective image forming stations Pa, Pb, Pc, Pd respectively form black (K), cyan (C), magenta (M), and yellow (Y) toner images, toner images of respective colors being transferred to intermediate transfer belt(s) 11 of intermediate transfer belt unit 2. These image forming stations Pa, Pb, Pc, Pd are equipped with respective developer units 21*a* through 21*d*; respective photosensitive drums 23*a* through 23*d*; respective charging units 24*a* through 24*d*; respective cleaning units 25*a* through 25*d*; and so forth.

Respective photosensitive drums 23*a* through 23*d*, being pressed upon by respective primary transfer rollers 26*a* through 26*d* by way of intervening intermediate transfer belt(s) 11, rotate together with intermediate transfer belt(s) 11, the peripheral velocity thereof being identical to that of intermediate transfer belt(s) 11 which move in rotating fashion in the direction indicated by arrow B. Furthermore, rotation of respective primary transfer rollers 26*a* through 26*d* likewise tracks rotation of intermediate transfer belt(s) 11, the peripheral velocity thereof being identical to that of intermediate transfer belt(s) 11 which move in rotating fashion in the direction indicated by arrow B.

Respective charging units 24*a* through 24*d*, which may be of the charger type and/or which may take the form of brush(es) and/or roller(s) that come in contact with photosensitive drums 23*a* through 23*d*, cause the surfaces of respective photosensitive drums 23*a* through 23*d* to become uniformly charged.

Exposing unit 1—which has laser source(s) 1*a* that emit respective laser beams bound for respective photosensitive drums 23*a* through 23*d*; plurality of mirrors 1*b* guiding respective laser beams to photosensitive drums 23*a* through 23*d*; and so forth-causes respective surfaces of photosensitive drums 23*a* through 23*d* to be irradiated with respective laser beams while respective laser beams are modulated in correspondence to image data, forming respective latent electrostatic image(s) on respective surfaces of photosensitive drums 23*a* through 23*d*.

Moreover, as exposing unit 1, write head(s) in which EL, LED, and/or other such light-emitting elements are arranged in array-like fashion may be employed.

Respective developer units 21*a* through 21*d*, which store toner of respective colors, cause toner of respective colors to adhere to latent electrostatic image(s) on surfaces of respective photosensitive drums 23*a* through 23*d*, forming toner images of respective colors on surfaces of respective photosensitive drums 23*a* through 23*d*. These toner images are transferred in overlapping fashion from respective photosensitive drums 23*a* through 23*d* to intermediate transfer belt(s) 11.

Intermediate transfer belt unit 2—which is equipped with intermediate transfer belt(s) 11; respective primary transfer rollers 26*a* through 26*d*; supporting drive roller(s) 31; supporting idler roller(s) 32; secondary transfer roller(s) 33; and so forth—causes intermediate transfer belt(s) 11 to be suspended between supporting drive roller(s) 31 and supporting idler roller(s) 32 such that intermediate transfer belt(s) 11 is/are supported so as to permit movement in rotating fashion, and causes respective primary transfer rollers 26*a* through 26*d* and secondary transfer roller(s) 33 to press against intermediate transfer belt(s) 11.

Intermediate transfer belt(s) 11 may, for example, be formed from synthetic resin film of thickness on the order of 100 μ to 150 μ. Secondary transfer roller 33 is supported so as to permit horizontal movement, and upon moving to the right, cooperates with supporting drive roller 31 to form a nip region within which intermediate transfer belt 11 is captured. Supporting drive roller 31, while serving as opposing roller for secondary transfer roller 33, is driven in rotational fashion and pulls on intermediate transfer belt 11, causing it to move in rotating fashion in the direction indicated by arrow B, respective nip regions between respective primary transfer rollers 26*a* through 26*d* and respective photosensitive drums 23*a* through 23*d* being located downstream therefrom. This makes it possible for the respective nip regions to be maintained in stable fashion.

Moreover, in order to cause respective nip regions between respective primary transfer rollers 26*a* through 26*d* and respective photosensitive drums 23*a* through 23*d* to be maintained in more stable fashion, either respective primary transfer rollers 26*a* through 26*d* or respective photosensitive drums 23*a* through 23*d* may be formed from hard material(s), with the others being formed from elastic material(s).

Respective primary transfer rollers 26*a* through 26*d* may, for example, be metal shafts of diameter 8 mm to 10 mm, the outside circumferences of which are covered by electrically conductive elastic material(s) (e.g., EPDM, urethane foam, etc.). With intermediate transfer belt 11 captured in the nip regions between respective primary transfer rollers 26*a* through 26*d* and respective photosensitive drums 23*a* through 23*d*, bias voltage(s) opposite in polarity to toner charge polarity is/are applied to said respective primary transfer rollers 26*a* through 26*d*; and, respective electric fields being made to act on toner at the surfaces of respective photosensitive drums 23*a* through 23*d* by way of intermediate transfer belt 11, toner on the surfaces of respective photosensitive drums 23*a* through 23*d* is drawn onto and is transferred to intermediate transfer belt 11. As a result, toner images of respective colors are transferred in overlapping fashion to intermediate transfer belt 11.

Note that there is no objection to use of brush(es) or the like instead of roller(s) for respective primary transfer rollers 26*a* through 26*d*.

Cleaning unit(s) 34—which may, for example, be cleaning blade(s) or the like which is/are capable of coming into sliding contact with the surface of intermediate transfer belt 11—removes toner from the surface of intermediate transfer belt 11, preventing fogging of image(s) from occurring the next time that printing takes place.

Toner images of respective colors that have thus been transferred in overlapping fashion to intermediate transfer belt 11 are transported to the nip region between supporting drive roller 31 and secondary transfer roller 33 in accompaniment to movement in rotating fashion of said intermediate transfer belt 11. In addition, lead edges of toner images of respective colors on intermediate transfer belt 11 are aligned with the lead edge of recording paper transported thereto by registration roller pair 8, causing toner images of respective colors to coincide with the recording paper, and causing toner images of respective colors to be transferred to the recording paper.

The recording paper is then transported to fuser unit 3, where it is compressed between pressure roller(s) 3*a* and hot roller(s) 3*b*. This causes toner of respective colors on the recording paper to be heated and melted and to be blended, the toner images of respective colors undergoing fusing to become color images on the recording paper.

Moreover, the recording paper is transported to discharge tray 35 by paper transport apparatus 4, where it is discharged in face-down fashion.

Note that it is also possible to form monochromatic image(s) using only image forming station Pa, the monochromatic image(s) being transferred to intermediate transfer belt(s) 11 of intermediate transfer belt unit(s) 2. As was the case for color image(s), such monochromatic image(s) would be transferred from intermediate transfer belt 11 to recording paper and would be fused onto recording paper.

Furthermore, when carrying out printing on not only the front side of recording paper but on both sides thereof, fuser unit 3 fuses image(s) onto the front side of the recording paper, following which transport roller pair(s) 4-3 of paper transport apparatus 4 is/are first made to stop at a point during transport of the recording paper by transport roller pair 4-3 and is/are thereafter driven in reverse fashion so as to cause the recording paper to travel along flipping path(s) 4*r* of paper transport apparatus 4, where the recording paper is flipped such that front and back thereof are reversed, and the recording paper is guided to registration roller pair(s) 8, so that just as was the case for the front side of the recording paper, image(s) are recorded and fused onto the back side of the recording paper, and the recording paper is discharged into discharge tray(s) 35.

However, the multiple capabilities of such an image forming apparatus cause the number of the various constituent elements to be high and its size to be large, and there is also demand for improved positional accuracy among various constituent elements and new levels of reduction and so forth with respect to vibration, strain, and the like of the overall apparatus. This being the case, greater strength and dimensional accuracy, as well as ability to accommodate increases in size, will be demanded of the image forming apparatus support structure.

Figure 2:
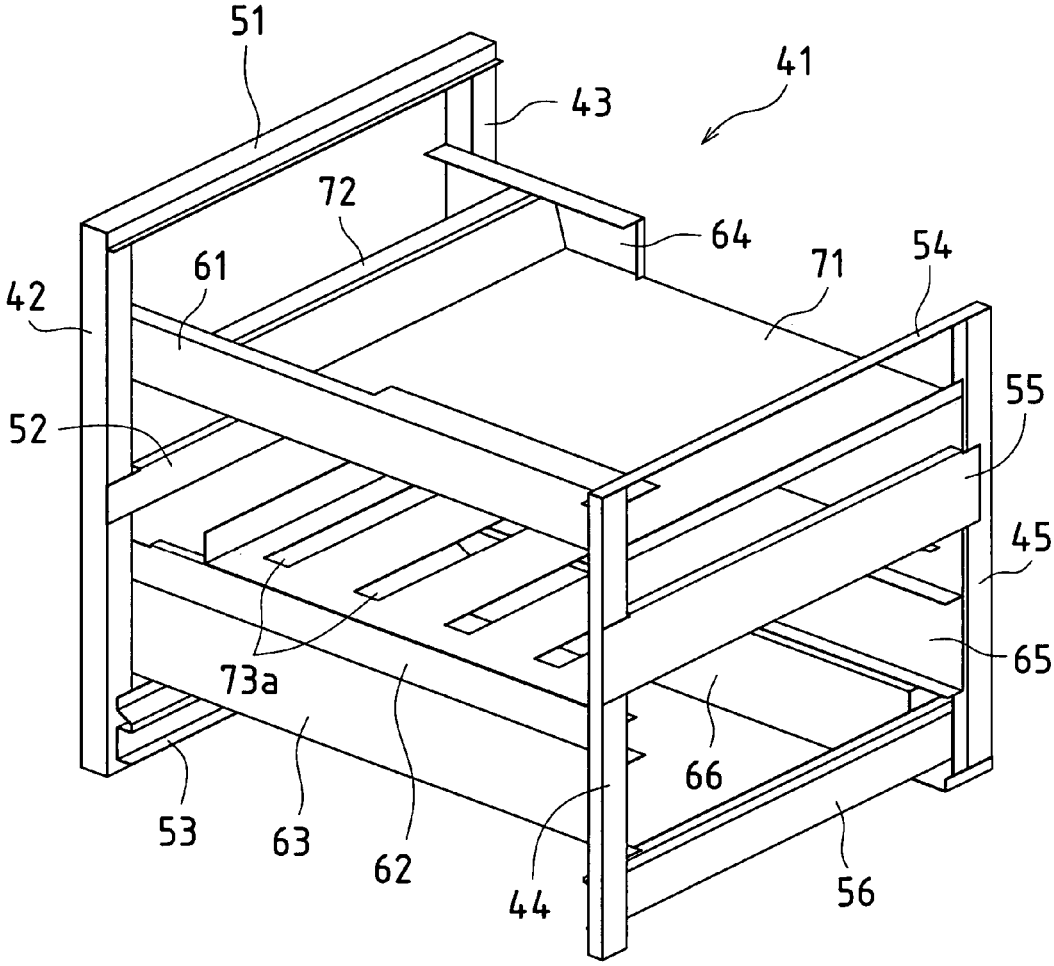
FIG. 2 is an oblique view showing an image forming apparatus support structure in accordance with the present embodiment.
Figure 3:
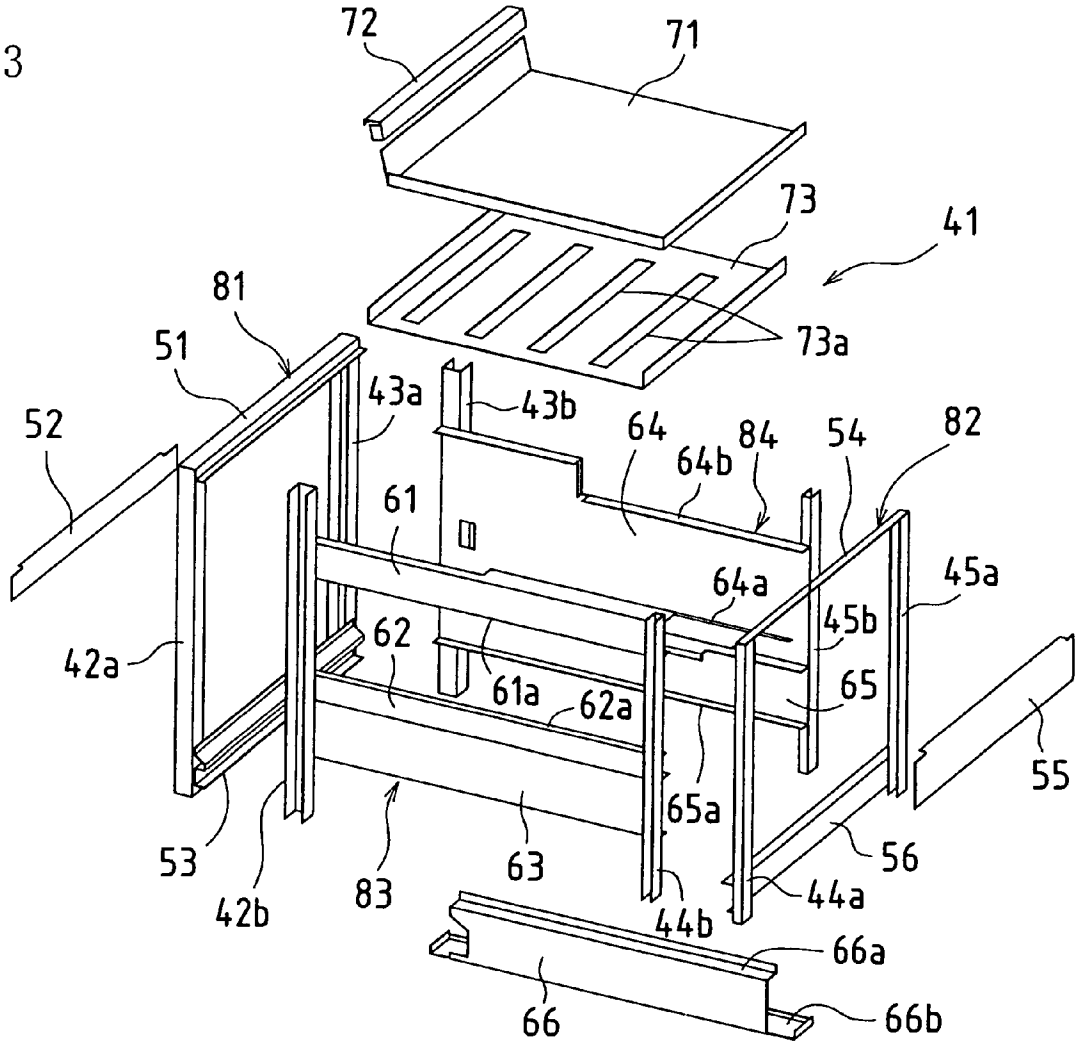
FIG. 3 is an oblique exploded view showing the support structure of FIG. 2.

The present embodiment therefore employs a support structure, as shown in FIGS. 2 and 3, which permits improvements in both strength and dimensional accuracy, and which can also accommodate increases in size. FIG. 2 is an oblique view showing the image forming apparatus support structure of the present embodiment; FIG. 3 is an oblique exploded view showing said support structure.

Support structure 41 of the present embodiment comprises four post members 42, 43, 44, 45; respective coupling members 51, 52, 53 which couple respective post members 42, 43; respective coupling members 54, 55, 56 which couple respective post members 44, 45; respective coupling members 61, 62, 63 which couple respective post members 42, 44; respective coupling members 64, 65, 66 which couple respective post members 43, 45; respective coupling members 71, 72 which couple respective coupling members 61, 64; and coupling member 73 which couples respective coupling members 62, 65.

Figure 4:
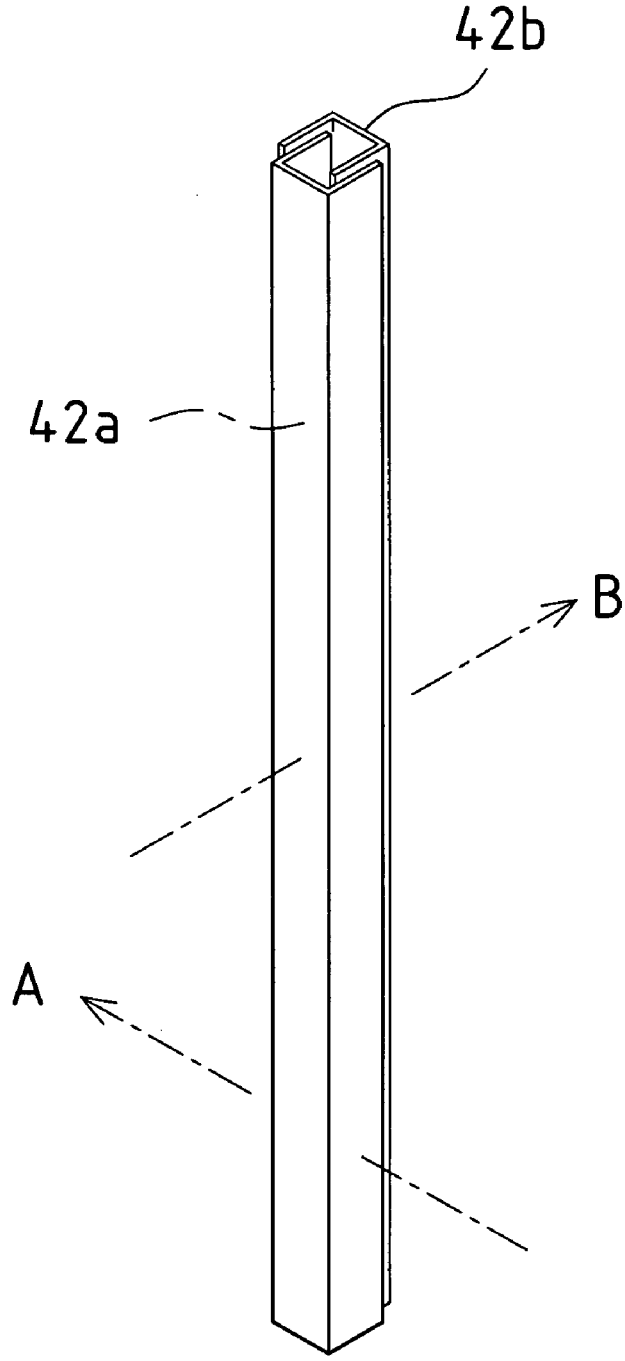
FIG. 4 is an oblique enlarged view showing a post member in the support structure of FIG. 2.

As shown in FIG. 4, post member 42 is a steel part having rectangular cross-section which is formed by combining pieces of steel channel 42*a*, 42*b* having more or less C-shaped cross-section; respective pieces of steel channel 42*a*, 42*b* being fastened by screws at a plurality of locations by means of a plurality of screws made to pass therethrough in parallel fashion with respect to the direction indicated by arrow A and/or the direction indicated by arrow B. Similarly, post member 43 is a rectangular steel part formed by combining respective pieces of steel channel 43*a*, 43*b* which are fastened with screws at a plurality of locations. Furthermore, post member 44 is a rectangular steel part formed by combining respective pieces of steel channel 44*a*, 44*b* which are fastened with screws at a plurality of locations. Moreover, post member 45 is a rectangular steel part formed by combining respective pieces of steel channel 45*a*, 45*b* which are fastened with screws at a plurality of locations.

Respective coupling members 51 through 56, 61 through 66, and 71 through 73 comprise sheet metal having more or less L-shaped cross-section(s) or more or less C-shaped cross-section(s) (what is referred to in the context of the present invention as member(s) having more or less L-shaped cross-section(s) and/or more or less C-shaped cross-section(s)) and/or sheet metal combining more or less L-shaped cross-section(s) and more or less C-shaped cross-section(s) (what is referred to in the context of the present invention as member(s) having more or less L-shaped cross-section(s) and/or more or less C-shaped cross-section(s)). Note, moreover, that whereas, in the present embodiment, sheet metal is used for coupling members 51 through 56, 61 through 66, and 71 through 73, the present invention is not limited thereto, it being sufficient for same to be member(s) having more or less L-shaped cross-section(s) and/or more or less C-shaped cross-section(s). For example, molded resin part(s) may be used for same.

Next, a procedure for assembling support structure 41 is described. The ends of respective pieces of steel channel 42*a*, 43*a* and respective coupling members 51, 52, 53 are first sequentially connected by spot welding and/or fastening with screws to form left subframe 81. Similarly, the ends of respective pieces of steel channel 44*a*, 45*a* and respective coupling members 54, 55, 56 are sequentially connected by spot welding and/or fastening with screws to form right subframe 82. Furthermore, the ends of respective pieces of steel channel 42*b*, 44*b* and respective coupling members 61, 62, 63 are sequentially connected by spot welding and/or fastening with screws to form front subframe 83. Similarly, the ends of respective pieces of steel channel 43*b*, 45*b* and respective coupling members 64, 65 are sequentially connected by spot welding and/or fastening with screws to form back subframe 84.

In addition, steel channel piece 42*b* of front subframe 83 is made to pass through the framed region enclosed by left subframe 81, following which steel channel piece 42*b* of front subframe 83 is combined with and fastened by screw(s) to steel channel piece 42*a* of left subframe 81, forming post member 42. Similarly, steel channel piece 44*b* of front subframe 83 is made to pass through the framed region enclosed by right subframe 82, following which steel channel piece 44*b* of front subframe 83 is combined with and fastened by screw(s) to steel channel piece 44*a* of right subframe 82, forming post member 44.

Furthermore, steel channel piece 43*b* of back subframe 84 is made to pass through the framed region enclosed by left subframe 81, following which steel channel piece 43*b* of back subframe 84 is combined with and fastened by screw(s) to steel channel piece 43*a* of left subframe 81, forming post member 43. Similarly, steel channel piece 45*b* of back subframe 84 is made to pass through the framed region enclosed by right subframe 82, following which steel channel piece 45*b* of back subframe 84 is combined with and fastened by screw(s) to steel channel piece 45*a* of right subframe 82, forming post member 45.

Moreover, with upper flat 66*a* of coupling member 66 pressed against lower flat 65*a* of coupling member 65 and with lower flat 66*b* of coupling member 66 pressed against the bottoms of respective post members 43, 45, coupling member 66 is connected by spot welding and/or fastening with screws to coupling member 65 and respective post members 43, 45.

By so doing, left subframe 81, right subframe 82, front subframe 83, and back subframe 84 are mutually coupled.

The ends of coupling member 73 are thereafter placed on upper flat 62*a* of coupling member 62 and ledge 64*a* of coupling member 64, and the ends of coupling member 73 are connected by spot welding and/or fastening with screws to respective coupling members 62, 64.

Moreover, coupling member 72 is connected by spot welding and/or fastening with screw(s) to the left end of coupling member 71. In addition, the ends of coupling member 71 are placed on lower flat 61*a* of coupling member 61 and side flat 64*b* of coupling member 64, and the ends of coupling member 71 are connected by spot welding and/or fastening with screws to respective coupling members 61, 64.

After support structure 41 has been assembled in such fashion, various constituent elements of the image forming apparatus are mounted on support structure 41. For example, discharge tray 35 might be arranged over coupling member 71 of support structure 41. Furthermore, respective image forming stations Pa, Pb, Pc, Pd, intermediate transfer belt unit 2, fuser unit 3, and the like may be mounted on and secured to coupling member 73 of support structure 41; and exposing unit 1 may be arranged and secured below coupling member 73. Respective slits 73*a* of coupling member 73 are for allowing respective laser beams to pass therethrough to respective image forming stations Pa, Pb, Pc, Pd from exposing unit 1. Moreover, the ends of media supply apparatus 5 might be slidably supported between respective coupling members 63, 66 of support structure 41. Media supply apparatus 5 might be supported so as to permit sliding horizontally between upper automatic-feed cassette(s) 6 and exposing unit 1 at the interior of the image forming apparatus, permitting same to be pulled out toward the exterior of the image forming apparatus. Furthermore, paper transport apparatus 4 might be secured to front subframe 83 of support structure 41. Moreover, the ends of automatic-feed cassette(s) 6 might be slidably supported between respective coupling members 53, 55 of support structure 41.

Because respective coupling members 51 through 56, 61 through 66, and 71 through 73 and steel channel of respective post members 42 through 45 are thus in the present embodiment sequentially and individually connected, it is possible to improve dimensional accuracy of support structure 41, it being possible to assemble support structure 41 such that deviations in the respective coupling members and the respective post members offset one another. For example, even if respective pieces of steel channel 42*a*, 42*b* of post member 42 have some degree of twist, upon assembling respective pieces of steel channel 42*a*, 42*b* and fastening same with screw(s), twist present at respective pieces of steel channel 42*a*, 42*b* can offset one another. The same thing is likewise true with respect to the other post members 43 through 45. Furthermore, even if respective coupling members 51 through 56, 61 through 66, and 71 through 73 have some degree of twist, at each connection during sequential assembly of these coupling members, coupling member twist can offset one another in mutual fashion by twist of other respective coupling members and/or respective post members by way of respective subframes 81 through 84. Furthermore, not only twist at the individual respective post members and respective coupling members, but also twist present at respective locations in accompaniment to error(s) in dimensions of respective post members and respective coupling members can, for similar reasons, moreover offset one another. This improves dimensional accuracy of respective subframes 81 through 84 and/or of the overall support structure 41.

Furthermore, steel channel is suitable for supporting load(s) in vertical direction(s). For this reason, it will be the case that respective post members 42 through 45, each of which comprises two pieces of steel channel that have been combined and fastened by screw(s), will be more suitable for supporting load(s) in vertical direction(s). And not only that, it will also be possible to cause the space occupied by respective post members 42 through 45 to be made extremely small and to cause the space at the interior of said respective post members to be made large, facilitating creation of space for containing various constituent elements of the image forming apparatus.

Moreover, because respective coupling members 51 through 56, 61 through 66, and 71 through 73 comprise sheet metal having more or less L-shaped cross-section(s) or more or less C-shaped cross-section(s) and/or sheet metal combining more or less L-shaped cross-section(s) and more or less C-shaped cross-section(s), strength thereof is high. Moreover, with respective post members 42 through 45 coupled by said respective coupling members, because said respective coupling members serve as braces between said respective post members, strength of respective subframes 81 through 84 and/or of the overall support structure 41 will be extremely high, and strain exhibited by respective subframes 81 through 84 and/or of the overall support structure 41 will be reduced. This being the case, even where various constituent elements of the image forming apparatus are mounted on support structure 41, there being little tendency for occurrence of strain and/or vibration of support structure 41, it will be possible for dimensional accuracy of support structure 41 as well as positional accuracy among various constituent elements of the image forming apparatus to be continuously maintained at high levels.

Furthermore, by employing respective post members combining pieces of steel channel, and by employing respective coupling members comprising sheet metal having more or less L-shaped cross-section(s) or more or less C-shaped cross-section(s) and/or sheet metal combining more or less L-shaped cross-section(s) and more or less C-shaped cross-section(s), it is possible to improve strength of support structure 41 without causing concomitant increase in weight of support structure 41.

In contradistinction hereto, where support structures employ combination(s) only of steel part(s) having C-shaped cross-section and/or steel part(s) having rectangular cross-section as has conventionally been the case, there being nothing corresponding to the respective coupling members of the present embodiment, adequate strength cannot be obtained. This being the case, even if it might have been possible for dimensional accuracy of the support structure to be maintained when various constituent elements of the image forming apparatus were not mounted thereon, when various constituent elements of the image forming apparatus are mounted thereon the inadequate strength of the support structure would cause occurrence of deviation(s) in the support structure, making it impossible to maintain positional accuracy among various constituent elements of the image forming apparatus.

Furthermore, because respective coupling members 71, 73 and so forth of support structure 41 may serve as outer wall panel(s) for respective image forming stations Pa, Pb, Pc, Pd, intermediate transfer belt unit 2, exposing unit 1, and the like, it is possible to reduce weight and parts count of the image forming apparatus.

Note that the present invention is not limited to the foregoing embodiment but admits of a great many variations thereon. For example, changes may be made as appropriate with respect to features such as location(s), shape(s) and/or dimension(s), and number(s) of respective post member(s) and respective coupling member(s). Furthermore, procedure(s) for assembling respective post member(s) and respective coupling member(s) may be established as appropriate in correspondence to support structure configuration and the like.

Furthermore, the present invention may be embodied in a wide variety of forms other than those presented herein without departing from the spirit or essential characteristics thereof. The foregoing embodiments and working examples, therefore, are in all respects merely illustrative and are not to be construed in limiting fashion. The scope of the present invention being as indicated by the claims, it is not to be constrained in any way whatsoever by the body of the specification. All modifications and changes within the range of equivalents of the claims are, moreover, within the scope of the present invention.

What is claimed is:

1. An image forming apparatus support structure for supporting various constituent elements making up an image forming apparatus, the image forming apparatus support structure comprising:

a plurality of post members; and a plurality of coupling members mutually coupling at least a portion of the post members;

wherein at least a portion of the post members comprises steel channel having more or less C-shaped cross-section;

at least a portion of the coupling members comprises at least one member having more or less L-shaped cross-section and/or more or less C-shaped cross-section;

at least a portion of the post members and at least a portion of the coupling members are individually connected at each end thereof by spot welding and/or by fastening with at least one screw to form the image forming apparatus support structure and, wherein at least one of the post members is a steel part having rectangular cross-section and formed by fixedly combining two pieces of steel channel; and wherein at least one of the coupling members includes slits on its surface for allowing respective laser beams to pass therethrough.

2. An image forming apparatus support structure according to claim 1 wherein at least one of the coupling members is used as at least one outer wall panel for the constituent elements of at least one of the image forming apparatus.

3. An image forming apparatus support structure according to claim 1 wherein the coupling members are molded resin.

* * * * *